US009510639B2

(12) United States Patent
Cruikshank et al.

(10) Patent No.: US 9,510,639 B2
(45) Date of Patent: Dec. 6, 2016

(54) HOCKEY SKATE

(71) Applicant: Bauer Hockey, Inc., Exeter, NH (US)

(72) Inventors: David Cruikshank, Delafield, WI (US); Aky Hung, Taichung (TW); Dmitry Rusakov, Van Nuys, CA (US); Ian Fung, Van Nuys, CA (US); Will Keegan, Van Nuys, CA (US); Mike Snow, Van Nuys, CA (US)

(73) Assignee: BAUER HOCKEY, INC., Exeter, NH (US)

( * ) Notice: Subject to any disclaimer, the term of this patent is extended or adjusted under 35 U.S.C. 154(b) by 672 days.

(21) Appl. No.: 13/794,071

(22) Filed: Mar. 11, 2013

(65) Prior Publication Data

US 2014/0250733 A1 Sep. 11, 2014

(51) Int. Cl.
*A43B 5/16* (2006.01)
*A43B 23/02* (2006.01)

(52) U.S. Cl.
CPC ..... *A43B 5/1625* (2013.01); *A43B 5/1616* (2013.01); *A43B 5/1666* (2013.01); *A43B 5/1691* (2013.01); *A43B 23/0225* (2013.01)

(58) Field of Classification Search
CPC . A43B 5/1616; A43B 5/1625; A43B 5/1691
USPC ..... 36/115, 10, 117.6, 117.8
See application file for complete search history.

(56) References Cited

U.S. PATENT DOCUMENTS

| | | | |
|---|---|---|---|
| 41,694 | A | 2/1864 | Getty |
| 61,998 | A | 2/1867 | Bushman |
| 275,482 | A | 4/1883 | Gregg |
| 439,161 | A | 10/1890 | Krause |
| 703,828 | A | 7/1902 | Read |
| 1,598,504 | A | 8/1926 | Pierce et al. |
| 2,211,822 | A | 8/1940 | Jennings |
| 2,230,553 | A | 2/1941 | Weisman |

(Continued)

FOREIGN PATENT DOCUMENTS

| | | |
|---|---|---|
| CA | 1190571 | 7/1985 |
| CA | 2292995 | 6/2000 |

(Continued)

OTHER PUBLICATIONS

Reinhardt, Five Popular Women's Ice Hockey Skates, Yahoo Contributor Network, Dec. 9, 2009. Retrieved from the internet: <http://voices.yahoo.com/five-popular-womens-ice-skates-2039606.html>.

(Continued)

*Primary Examiner* — Ted Kavanaugh

(57) ABSTRACT

A hockey skate includes a composite boot form having a rigid lower portion and a less rigid upper portion. The upper portion may be made of a thermoformable material that conforms to the shape of a wearer's foot and ankle. The construction of the boot form—particularly the lower portion of the boot form—may be varied across different size ranges by, for example, varying the fiber angles in the composite material. Varying the stiffness of the lower portion of the boot form in this manner allows the flexibility of different sized boots to be substantially equalized. A skate quarter and other skate-boot features may readily be attached to the upper portion of the boot form via stitching, rivets, or other connectors. The boot form also may include an integral toe cap having a flange or other element to which the skate tongue and other elements may be connected.

15 Claims, 2 Drawing Sheets

(56) References Cited

U.S. PATENT DOCUMENTS

| | | | |
|---|---|---|---|
| 2,563,763 | A | 8/1951 | Vietas |
| 2,617,207 | A | 11/1952 | Jennett |
| 2,789,374 | A | 4/1957 | Planert |
| 2,918,734 | A | 12/1959 | Hyde |
| 3,235,978 | A | 2/1966 | Hyde |
| 3,243,191 | A | 3/1966 | Weisman |
| 3,729,841 | A | 5/1973 | Wagner |
| 4,072,317 | A | 2/1978 | Pommerening |
| 4,107,856 | A | 8/1978 | Bourque |
| 4,222,184 | A | 9/1980 | Kastinger |
| 2,473,280 | A | 7/1981 | Decamp et al. |
| 4,280,286 | A | 7/1981 | Santor |
| 4,384,413 | A | 5/1983 | Bourque |
| 4,453,727 | A | 6/1984 | Bourque |
| 4,509,276 | A | 4/1985 | Bourque |
| 4,561,196 | A | 12/1985 | Petrini et al. |
| 4,615,127 | A | 10/1986 | Delery |
| 4,655,465 | A | 4/1987 | Schaeffer |
| 4,773,658 | A | 9/1988 | Bourque et al. |
| 4,835,885 | A | 6/1989 | Hoshizaki et al. |
| 4,865,023 | A | 9/1989 | Craythorne et al. |
| 4,869,001 | A | 9/1989 | Brown |
| 4,901,455 | A | 2/1990 | Morell et al. |
| 4,964,229 | A | 10/1990 | Laberge |
| 5,016,623 | A | 5/1991 | Krahenbuhl |
| 5,050,138 | A | 9/1991 | Yamada et al. |
| 5,050,620 | A | 9/1991 | Cooper |
| 5,072,529 | A | 12/1991 | Graf |
| 5,090,138 | A | 2/1992 | Borden |
| D324,447 | S | 3/1992 | Purdom |
| 5,171,033 | A | 12/1992 | Olson et al. |
| 5,255,929 | A | 10/1993 | Lemelson |
| 5,272,823 | A | 12/1993 | Perrissoud |
| 5,295,316 | A | 3/1994 | Bergamin |
| 5,329,705 | A | 7/1994 | Grim et al. |
| 5,400,529 | A | 3/1995 | Bell et al. |
| 5,406,721 | A | 4/1995 | Marcolin |
| 5,408,763 | A | 4/1995 | Sartor et al. |
| 5,437,466 | A | 8/1995 | Meibock et al. |
| 5,452,907 | A | 9/1995 | Meibock et al. |
| 5,491,911 | A | 2/1996 | Chen |
| 5,498,033 | A | 3/1996 | Hoshizaki et al. |
| 5,505,467 | A | 4/1996 | Hill et al. |
| 5,575,091 | A | 11/1996 | Mattiuzzo |
| 5,662,338 | A | 9/1997 | Steinhauser, Jr. |
| 5,694,703 | A | 12/1997 | Diaz |
| 5,769,434 | A | 6/1998 | Wurthner |
| 5,778,565 | A | 7/1998 | Holt et al. |
| 5,779,246 | A | 7/1998 | Bengtsson |
| 5,794,362 | A | 8/1998 | Polk et al. |
| 5,799,955 | A | 9/1998 | Iverson |
| 5,819,440 | A | 10/1998 | Okajima |
| 5,822,887 | A | 10/1998 | Turner |
| 2,766,065 | A | 1/1999 | Salomon |
| 5,875,566 | A | 3/1999 | Bourdeau et al. |
| 5,887,361 | A | 3/1999 | Cabanis et al. |
| 5,926,978 | A | 7/1999 | Smith |
| 5,926,979 | A | 7/1999 | Borel |
| 2,774,563 | A | 8/1999 | Salomon |
| 5,933,986 | A | 8/1999 | Donnadieu |
| 5,937,546 | A | 8/1999 | Messmer |
| 5,966,843 | A | 10/1999 | Sand et al. |
| 5,967,531 | A | 10/1999 | Saillet |
| 5,971,405 | A | 10/1999 | Edauw |
| 6,018,892 | A | 2/2000 | Acheson et al. |
| 6,047,975 | A | 4/2000 | Benoit et al. |
| 6,070,886 | A | 6/2000 | Cornelius et al. |
| 6,070,887 | A | 6/2000 | Cornelius et al. |
| 6,076,285 | A | 6/2000 | Caeran et al. |
| 6,079,128 | A | 6/2000 | Hoshizaki et al. |
| 6,102,881 | A | 8/2000 | Quackenbush et al. |
| 6,109,622 | A | 8/2000 | Reynolds |
| 6,112,434 | A | 9/2000 | Seltzer et al. |
| 6,120,038 | A | 9/2000 | Dong et al. |
| 6,138,384 | A | 10/2000 | Messmer |
| 6,139,030 | A | 10/2000 | Meibock et al. |
| 6,152,459 | A | 11/2000 | Meibock et al. |
| 6,168,172 | B1 | 1/2001 | Meibock et al. |
| 6,217,036 | B1 | 4/2001 | Rowledge |
| 6,223,457 | B1 | 5/2001 | Graf |
| 6,254,110 | B1 | 7/2001 | Meibock et al. |
| 6,260,290 | B1 | 7/2001 | Chenevert |
| 6,293,564 | B1 | 9/2001 | Gabrielli |
| 6,293,565 | B1 | 9/2001 | Bouchard et al. |
| 6,295,679 | B1 * | 10/2001 | Chenevert ..... A43B 3/26 12/142 P |
| 6,321,466 | B1 | 11/2001 | Bordin et al. |
| D455,836 | S | 4/2002 | Lammers |
| 6,364,321 | B1 | 4/2002 | Steinhauser, Jr. |
| 6,367,818 | B2 | 4/2002 | Meibock et al. |
| 6,371,494 | B1 | 4/2002 | Bonaventure et al. |
| 6,381,877 | B2 | 5/2002 | Filice |
| 6,419,241 | B1 | 7/2002 | Chenevert |
| 6,519,877 | B2 | 2/2003 | Oetting et al. |
| 6,533,295 | B2 | 3/2003 | Gonthier |
| 6,550,159 | B1 | 4/2003 | Madore |
| 6,557,864 | B1 | 5/2003 | Lenoir |
| 6,601,042 | B1 | 7/2003 | Lyden |
| 6,725,577 | B2 | 4/2004 | Mazzarolo |
| 6,769,203 | B1 | 8/2004 | Wright et al. |
| 6,935,054 | B2 | 8/2005 | Hall et al. |
| 6,993,860 | B2 | 2/2006 | Bettiol |
| 7,039,977 | B2 | 5/2006 | Wilder |
| 7,082,703 | B2 | 8/2006 | Greene et al. |
| 7,140,127 | B2 | 11/2006 | Yang |
| 7,171,768 | B2 | 2/2007 | Klein |
| 7,219,450 | B2 | 5/2007 | Langley |
| 7,219,900 | B2 | 5/2007 | Meibock |
| 7,290,355 | B2 | 11/2007 | Labonte |
| 7,290,773 | B2 | 11/2007 | Eck |
| 7,325,813 | B2 | 2/2008 | Bock |
| RE40,363 | E | 6/2008 | Grim et al. |
| 7,380,354 | B2 | 6/2008 | Yamashita et al. |
| 7,387,302 | B2 | 6/2008 | Goldsmith et al. |
| 7,392,990 | B2 | 7/2008 | Bussiere |
| 7,398,609 | B2 | 7/2008 | Labonte |
| 7,451,991 | B2 | 11/2008 | Labonte |
| 7,533,479 | B2 | 5/2009 | LaBonte |
| 7,562,881 | B2 | 7/2009 | Crowder |
| 7,712,173 | B2 | 5/2010 | Labonte |
| 7,770,930 | B2 | 8/2010 | McLeod |
| 7,793,947 | B2 | 9/2010 | LaBonte |
| 7,806,418 | B2 | 10/2010 | Labonte et al. |
| 7,896,363 | B2 | 3/2011 | Lovejoy |
| 7,908,771 | B2 | 3/2011 | Foxen et al. |
| 7,950,676 | B2 * | 5/2011 | Goldsmith ..... A43B 5/1625 280/11.12 |
| 8,109,536 | B2 | 2/2012 | Labonte |
| 8,302,329 | B2 | 11/2012 | Hurd et al. |
| 8,353,535 | B2 | 1/2013 | Salmon et al. |
| 8,387,286 | B2 | 3/2013 | Koyess et al. |
| 8,479,416 | B2 * | 7/2013 | Auger ..... A43B 7/1445 36/102 |
| 8,684,368 | B2 | 4/2014 | Van Horne |
| 8,745,898 | B2 | 6/2014 | Stewart |
| 2001/0006282 | A1 | 7/2001 | Green et al. |
| 2001/0022434 | A1 | 9/2001 | Sauter et al. |
| 2001/0026054 | A1 | 10/2001 | Olson et al. |
| 2003/0015848 | A1 | 1/2003 | Pham et al. |
| 2003/0097769 | A1 | 5/2003 | Gabrielli |
| 2003/0102641 | A1 | 6/2003 | Liu |
| 2003/0115775 | A1 | 6/2003 | Mazzarolo |
| 2003/0115777 | A1 | 6/2003 | Hall et al. |
| 2003/0193152 | A1 | 10/2003 | Meibock et al. |
| 2003/0196351 | A1 | 10/2003 | Hipp et al. |
| 2003/0204971 | A1 | 11/2003 | Fauver |
| 2004/0007836 | A1 | 1/2004 | Sauter et al. |
| 2004/0016150 | A1 | 1/2004 | Labonte et al. |
| 2004/0049950 | A1 | 3/2004 | Van Horne |
| 2004/0083625 | A1 | 5/2004 | Wilder |
| 2004/0090023 | A1 | 5/2004 | Crowder |
| 2004/0140631 | A1 | 7/2004 | Goldsmith et al. |
| 2004/0168357 | A1 | 9/2004 | Meibock |
| 2004/0194350 | A1 | 10/2004 | Mazzarolo |

(56) References Cited

U.S. PATENT DOCUMENTS

| | | | | |
|---|---|---|---|---|
| 2004/0200099 | A1 | 10/2004 | Chenevert | |
| 2004/0207164 | A1 | 10/2004 | Meibock et al. | |
| 2004/0226113 | A1 | 11/2004 | Wright et al. | |
| 2004/0261298 | A1 | 12/2004 | Howard | |
| 2005/0116379 | A1 | 6/2005 | Goldsmith et al. | |
| 2005/0126046 | A1 | 6/2005 | Labonte et al. | |
| 2005/0134010 | A1 | 6/2005 | Blankenburg et al. | |
| 2005/0193594 | A1 | 9/2005 | Murphy | |
| 2005/0204585 | A1 | 9/2005 | Loveridge et al. | |
| 2005/0223604 | A1 | 10/2005 | Neuner | |
| 2005/0229436 | A1 | 10/2005 | Bock | |
| 2005/0267775 | A1 | 12/2005 | Willis | |
| 2005/0273028 | A1 | 12/2005 | Reynolds et al. | |
| 2005/0280222 | A1 | 12/2005 | Sauter et al. | |
| 2006/0053662 | A1* | 3/2006 | Yang | A43B 5/1683 36/115 |
| 2006/0064904 | A1 | 3/2006 | Confortin et al. | |
| 2006/0145434 | A1 | 7/2006 | Crowder | |
| 2006/0179686 | A1 | 8/2006 | Labonte | |
| 2006/0179687 | A1 | 8/2006 | Labonte | |
| 2006/0181035 | A1 | 8/2006 | Labonte | |
| 2006/0181076 | A1 | 8/2006 | Labonte | |
| 2006/0201030 | A1 | 9/2006 | Wilder | |
| 2007/0013152 | A1 | 1/2007 | Goldsmith et al. | |
| 2007/0063457 | A1 | 3/2007 | Labonte et al. | |
| 2007/0186448 | A1 | 8/2007 | Meibock | |
| 2008/0018066 | A1 | 1/2008 | Pickford | |
| 2008/0150242 | A1 | 6/2008 | Wurthner | |
| 2008/0172906 | A1 | 7/2008 | Jou et al. | |
| 2008/0238006 | A1 | 10/2008 | Labonte | |
| 2009/0000151 | A1 | 1/2009 | Cavasin | |
| 2009/0020967 | A1 | 1/2009 | Weber et al. | |
| 2009/0188056 | A1 | 7/2009 | Labonte | |
| 2009/0243238 | A1 | 10/2009 | Van Horne et al. | |
| 2009/0289427 | A1 | 11/2009 | Lovejoy | |
| 2010/0109312 | A1 | 5/2010 | Salmon et al. | |
| 2010/0156058 | A1 | 6/2010 | Koyess et al. | |
| 2010/0192412 | A1 | 8/2010 | Stewart | |
| 2010/0275393 | A1 | 11/2010 | Jou et al. | |
| 2011/0016617 | A1 | 1/2011 | Shrewsburg | |
| 2011/0101665 | A1 | 5/2011 | Van Horne et al. | |
| 2012/0025478 | A1 | 2/2012 | Van Horne | |
| 2012/0204452 | A1 | 8/2012 | Van Horne | |
| 2013/0214499 | A1 | 8/2013 | Koyess et al. | |
| 2014/0097583 | A1 | 4/2014 | Vaughn | |

FOREIGN PATENT DOCUMENTS

| | | |
|---|---|---|
| CA | 2497037 | 1/2012 |
| CA | 2750906 | 10/2012 |
| FR | 2473280 | 7/1981 |
| FR | 2766065 | 1/1999 |
| FR | 2774563 | 8/1999 |
| WO | WO2013137970 | 9/2013 |

OTHER PUBLICATIONS

United States Patent and Trademark Office, International Search Report and Written Opinion for PCT/US13/20763, May 21, 2013.
Canadian Intellectual Property Office, Office Action for CA 2801233, Apr. 22, 2013.
Canadian Intellectual Property Office, Office Action for CA 2801233, Aug. 12, 2013.
European Patent Office, Extended European Search Report for EP 14158831.9 dated Jul. 24, 2014 (7 pages).
European Patent Office, Extended European Search Report for EP 14158854.1dated Jul. 24, 2014 (9 pages).
Bauer Turbo Molded Hockey Skates, Aug. 2013.
Bauer Lil Champ Toddler Ice Skates, Aug. 2013.
CCM Champion 90 Ice Hockey Skates, Aug. 2013.
KOR Hockey, Shift 2 model ice skates, NHL Digest product review dated Oct. 8, 2007.
Non-Final Office Action mailed Aug. 1, 2016 in connection with U.S. Appl. No. 14/094,599, 13 pages.

* cited by examiner

HOCKEY SKATE

BACKGROUND

The boot portions of hockey skates typically are constructed of substantially rigid materials. While these rigid constructions generally provide a wearer with suitable protection against impacts from pucks, sticks, and the like, the lack of flexibility in the skate boots—particularly in the upper regions of the skate boots—tends to restrict movement and limits the motions a skater can execute. Further, it is difficult to stitch or otherwise attach many materials to these rigid constructions, thus limiting the design options available to a skate designer.

SUMMARY

A hockey skate includes a composite boot form having a rigid lower portion and a less rigid upper portion. The upper portion may be made of a thermoformable material that conforms to the shape of a wearer's foot and ankle. The construction of the boot form—particularly the lower portion of the boot form—may be varied across different size ranges by, for example, varying the fiber angles in the composite material. Varying the stiffness of the lower portion of the boot form in this manner allows the flexibility of different sized boots to be substantially equalized. A skate quarter and other skate-boot features may readily be attached to the less rigid upper portion of the boot form via stitching, rivets, or other suitable connectors. The boot form also may include an integral toe cap having a flange or other element to which the skate tongue, skate quarter, abrasion guard, and other elements may be connected. Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list. Further, unless otherwise specified, terms such as "attached" or "connected" are intended to include integral connections, as well as connections between physically separate components.

Figure 1:
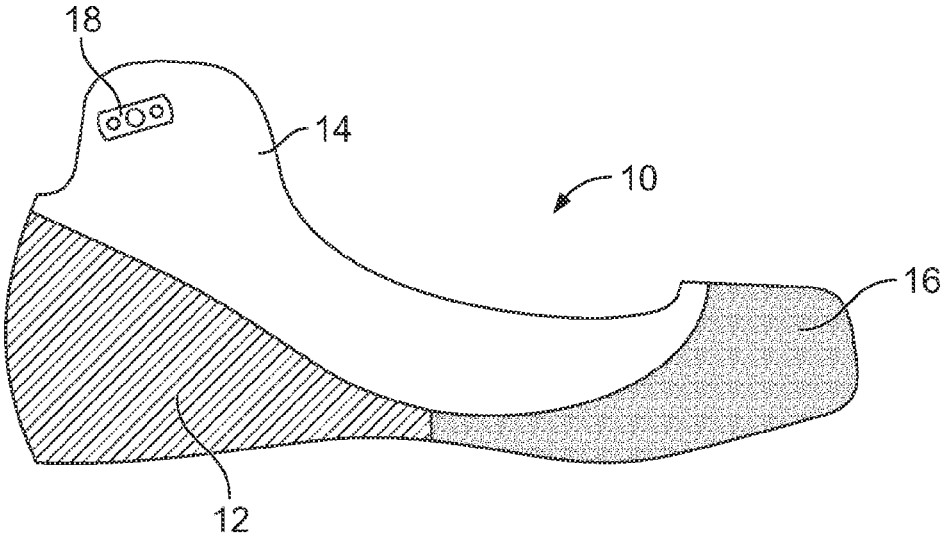
FIG. 1 is a perspective view of a boot form, according to one embodiment.
Figure 2:
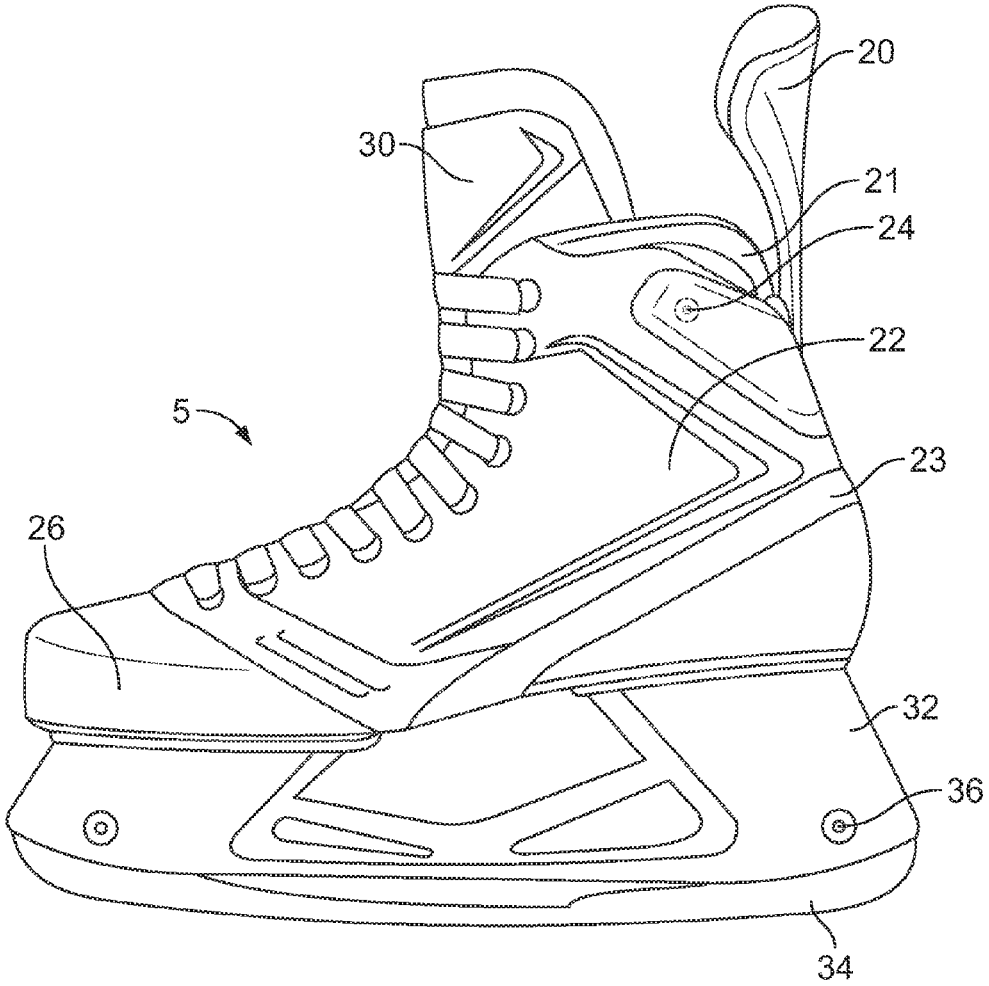
FIG. 2 is a perspective view of a hockey skate including the boot form shown in FIG. 1, according to one embodiment.

Turning now to FIGS. 1 and 2, a boot form 10 for a hockey skate 5 includes a rigid lower portion 12 and a less rigid upper portion 14. The upper portion 14 may be made of a thermoformable composite material, such as low density polyethylene, or of another material suitable for providing both structural support and relative flexibility in the upper portion 14. The lower portion 12 of the boot form 10 may be made of a rigid composite material, such as a carbon-fiber reinforced composite material, or of another suitable rigid material. The lower portion 12 of the boot form 10 may include an integral toe portion 16 made of the same material, or of a material having a similar rigidity, as the remainder of the lower portion 12. The various regions of the boot form 10 may be laid up and then cured together to form a unitary structure.

The boot form 10 may include multiple layers of material to yield an optimal flexibility for a given skate size. As the length and width of the skate 5 varies throughout the size ranges, the overall stiffness of the skate 5, if constructed in a uniform manner, also varies. A smaller-sized skate, for example, would have a greater stiffness than a similarly constructed larger-sized skate. Accordingly, the stiffness of the individual composite layers, particularly in the lower region 12 or the boot form 10, may be varied across different skate sizes to achieve a substantially equivalent skate stiffness or flexibility.

In one embodiment, the angles of the fibers in one or more layers of the boot form 10 may be adjusted based on the size of the skate 5. In skates having sizes 4 to 6.5, for example, the carbon or other fibers in the boot form 10 may be oriented to provide less relative stiffness than similarly situated fibers in skates having sizes 7-9.5, which may in turn have carbon or other fibers oriented to provide less relative stiffness than similarly situated fibers in skates having sizes 10 to 12.5. By varying the fiber angles in this manner, the overall flexion or torsional rigidity of the skate 5 can be substantially equalized throughout the available size ranges.

In one embodiment, the transition region between the upper portion 14 and the lower portion 12 of the boot form 10 is staggered during the layup process to provide a gradually changing flexibility along the length of the transition region. For example, the lower portion 12 of the boot form 10 may include one or more regions that extend upward beyond a neighboring region of the lower portion 12, or the lower portion 12 may include a stepped upper region providing a gradual increase or decrease in flexibility along the transition region. These arrangements may aid in the performance and durability of the skate 5.

Fastener elements 18 may be attached to or molded into the upper portion 14 of the boot form 10 to facilitate attachment of a tendon guard 20, a skate quarter 22, or other components. Screws 24, bolts, rivets, or other suitable fasteners may be used to engage the fastener elements 18 and to attach the components. In the illustrated embodiment, a portion of the skate quarter 22, as well as medial and lateral connecting portions of the tendon guard 20, are attached to the boot form 10 via screws 24 or similar connectors. In some embodiments, each of the medial and lateral connecting portions of the tendon guard 20 may be attached to the upper portion 14 of the boot form 10 by a plurality of connectors such as the screws 24 or similar connectors.

In one embodiment, two or more fastener elements 18 are included on each side of the boot form 10. As a result, the tendon guard 20 may be secured to multiple locations on each side of the boot form 10, thus preventing the tendon guard 20 from pivoting about the connection location. In another embodiment, stoppers 21 may additionally or alternatively be included at the upper regions of the skate boot to inhibit forward rotation of the tendon guard 20, as described, for example, in U.S. patent application Ser. No. 13/418,052, filed Mar. 12, 2012, which is incorporated herein by reference.

In one embodiment, a U-shaped notch or other opening is included in the rear of the skate boot to facilitate rearward extension of a wearer's ankle and lower leg during the skating motion. The tendon guard 20 may include a narrow mid-region to facilitate rearward flexing of the tendon guard 20, as described, for example, in U.S. patent application Ser. No. 13/271,029, filed Oct. 11, 2011, which is incorporated herein by reference.

The skate quarter 22 may be made of a thermoformable material, such as Surlyn®, high density polyethylene, or of another suitable material. Because the upper portion 14 of the boot form 10 is made of a thermoformable material or a similar material, the skate quarter 22 may be attached to the upper portion 14 of the boot form 10 via adhesives or stitching, as well as by the fasteners 18 described above. The use of a thermoformable upper portion 14 of the boot form 10, as well as a thermoformable skate quarter 22, facilitates conforming of the skate boot to the shape of a wearer's foot and ankle.

A molded protector 23 made of thermoplastic polyurethane, or of another suitable material, may be positioned over the lower edge of the skate quarter 22 to protect it from abrasion and from prying forces that could separate or delaminate the quarter 22 from the upper portion 14 of the boot form 10. Additionally, a molded toe cap 26 may be positioned over the integral toe portion 16 of the boot form 10. The toe cap 26 may be made of a plastic material, such as thermoplastic polyurethane, or of any other material suitable for providing protection to the toe region of the skate 5.

Figure 3:
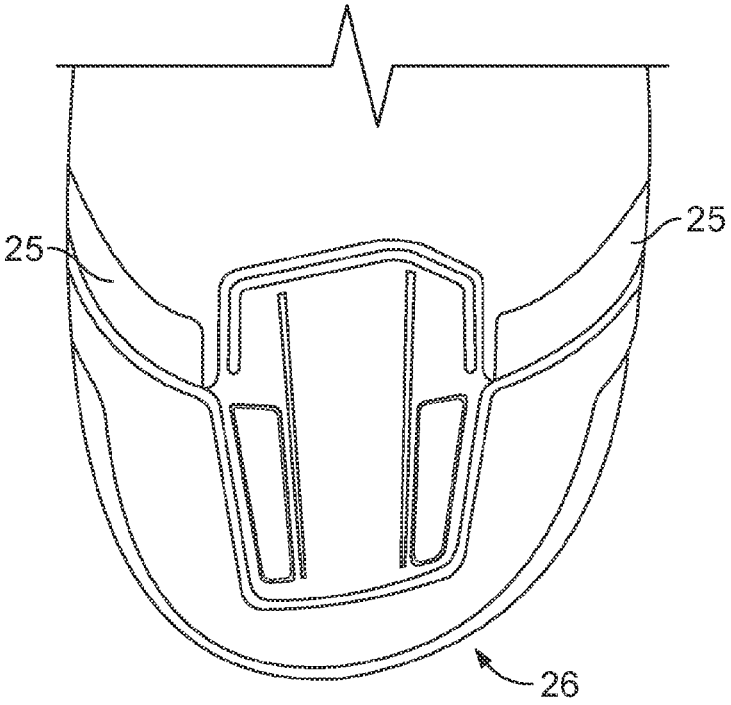
FIG. 3 is a perspective view of the toe cap of a skate boot, according to one embodiment.

As shown in FIG. 3, the toe cap 26 may include one or more flanges 25 or similar elements to which the skate quarter 22, the molded protector 23, or a skate tongue 30 may be attached. Connection of these components to the toe cap 26 may be advantageous, as it would be difficult to attach them directly to the rigid lower portion 12 of the boot form 10.

In one embodiment, the skate tongue 30 extends inside the toe region 16 of the boot form 10 to fill the space between the top of a wearer's foot and the upper, inner surface of the toe region 16. This arrangement provides comfort for the user, while also providing sensation and feedback during skating motions. In another embodiment, a separate filler element is positioned inside the toe region 16 adjacent to the end of the tongue 30 to provide similar benefits.

A blade holder 32 is attached to the lower portion 12 of the boot form 10 via screws, bolts, rivets, or other suitable connectors. The blade holder 32 may be made of DuPont Zytel® ST801 or of another suitable material. A blade 34 made of steel or of another suitable material is secured to the blade holder 32 via screws 36, rivets, bolts, or other suitable connectors.

Multiple layers of material may be included on the interior region of the lower portion 12 of the boot form 10 to facilitate increased grip or holding strength of the screws or other connectors used to secure the blade holder 32 to the lower portion 12 of the boot form 10. Because the lower portion 12 of the boot form 10 is rigid, it does not readily accept connectors. Providing additional layers of material, however, increases the holding strength of the connectors. Additionally, the toe cap 26 preferably does not wrap underneath the toe region 16 so that it does not interfere with the attachment of the lower portion 12 of the boot form 10 to the blade holder 32.

The skate boot 5 described herein may be constructed by arranging in a mold the composite layers that make up the lower portion 12, upper portion 14, and toe region 16 of the boot form 10. As described above, the fiber angles in the given layers may be selected to provide the stiffness properties desired for a given skate size. Also as described above, the layers of the lower and upper portions 12, 14 of the boot form 10 optionally may be staggered to provide a graduated transition region between them.

Once the layers are arranged in the mold they are be cured under heat and pressure to create the boot form 10. The thermoformable upper portion 14 of the boot form 10 softens at a temperature range that does not affect the rigidity of the rigid lower portion 12 of the boot form 10. The upper portion 14, therefore, is able to conform to the shape of a wearer's foot and, after cooling, remain in that shape so that the skate 5 remains conformed to a wearer's foot. The skate quarter 22, toe cap 26, tongue, 30, tendon guard 20, blade holder 32, and other skate components may then be attached to the boot form 10, or to each other, as described above.

Any of the above-described embodiments may be used alone or in combination with one another. Further, the hockey skate may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A hockey skate comprising:

a composite boot form having a lower portion and an upper portion;

a skate quarter attached to the upper portion of the boot form to overlie an upper region of a wearer's foot; and a tendon guard attached to the upper portion of the boot form and positioned at a rear region of the boot form;

wherein the upper portion comprises a first material and the lower portion comprises a second material that is more rigid than the first material such that the upper portion is less rigid than the lower portion, each of the first material and the second material being a composite material.

2. The hockey skate of claim 1 wherein the lower portion of the boot form includes an integral toe region configured to overlie toes of the wearer's foot.

3. The hockey skate of claim 2 further comprising a molded toe cap overlying the integral toe region of the lower portion of the boot form.

4. The hockey skate of claim 3 further comprising a tongue that extends into the integral toe region, wherein the tongue is attached to the toe cap.

5. The hockey skate of claim 1 wherein the tendon guard includes a medial connecting portion and a lateral connecting portion, the medial and lateral connecting portions of the tendon guard being attached to the upper portion of the boot form by a plurality of connectors.

6. The hockey skate of claim 1 further comprising a plurality of fastener elements attached to or integral with the upper portion of the boot form, wherein the skate quarter is attached to the upper portion of the boot form via the fastener elements.

7. The hockey skate of claim 6 wherein the tendon guard is attached to the upper portion of the boot form via the fastener elements.

8. The hockey skate of claim 1 further comprising a protector element overlying the skate quarter along an edge of the skate quarter where the skate quarter is connected to the boot form.

9. The hockey skate of claim 1 wherein each of a material of the skate quarter and the first material of the upper portion of the boot form includes at least one thermoformable material.

10. The hockey skate of claim 1 wherein an integration region between the lower portion of the boot form and the upper portion of the boot form provides a gradual change in flexibility from the lower portion to the upper portion.

11. The hockey skate of claim 1 further comprising a blade holder attached to the lower portion of the boot form.

12. A hockey skate, comprising:

a composite boot form having a lower portion and an upper portion that is less rigid than the lower portion; and a skate quarter attached to the upper portion of the boot form to overlie an upper region of a wearer's foot;

wherein the upper portion comprises a first thermoformable material and the skate quarter comprises a second thermoformable material.

13. The hockey skate of claim 12 further comprising a plurality of fastener elements attached to or integral with the upper portion of the boot form, wherein the skate quarter is attached to the upper portion of the boot form via the fastener elements.

14. The hockey skate of claim 1, wherein the upper portion is at least on a first lateral side of the boot form that extends higher than a second lateral side of the boot form.

15. The hockey skate of claim 2, wherein the integral toe region comprises the second material of the lower portion of the boot form.

* * * * *